US009328951B2

(12) United States Patent
Shin et al.

(10) Patent No.: US 9,328,951 B2
(45) Date of Patent: May 3, 2016

(54) REFRIGERATOR

(71) Applicant: LG ELECTRONICS, Seoul (KR)

(72) Inventors: Jaehoon Shin, Seoul (KR); Heayoun Sul, Seoul (KR); Changho Seo, Seoul (KR); Yongjoo Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 134 days.

(21) Appl. No.: 14/048,911

(22) Filed: Oct. 8, 2013

(65) Prior Publication Data

US 2014/0290302 A1 Oct. 2, 2014

(30) Foreign Application Priority Data

Apr. 1, 2013 (KR) ..... 10-2013-0035088

(51) Int. Cl.
*F25D 11/02* (2006.01)
*F25D 25/02* (2006.01)
*F25D 17/06* (2006.01)

(52) U.S. Cl.
CPC ..... *F25D 11/022* (2013.01); *F25D 25/025* (2013.01); *F25D 17/065* (2013.01)

(58) Field of Classification Search
CPC ..... F25D 25/025; F25D 11/02; F25D 11/022; F25D 11/04; F25D 23/068; F25D 23/061; F25D 2321/14; F25D 2321/1441; F25B 39/02; F25B 39/022
See application file for complete search history.

(56) References Cited

U.S. PATENT DOCUMENTS 2,741,898 A * 4/1956 Huettl ..... F25B 39/02 62/285
2,783,620 A * 3/1957 Herndon, Jr. ..... 62/156
2,900,806 A * 8/1959 Wurtz et al. ..... 62/186
2,937,511 A * 5/1960 Mann ..... F25B 39/02 62/186
2,942,432 A * 6/1960 Muffly ..... 62/155
3,034,313 A * 5/1962 Janos et al. ..... 62/155
3,103,797 A * 9/1963 Harley, Jr. ..... 62/419
3,263,440 A * 8/1966 Hellstrom ..... 62/288
3,904,721 A * 9/1975 Puterbaugh ..... 264/46.5
4,007,604 A * 2/1977 Ballarin ..... 62/174
5,983,654 A * 11/1999 Yamamoto et al. ..... 62/187
2002/0134095 A1* 9/2002 Temmyo et al. ..... 62/179
2008/0047294 A1* 2/2008 Hasegawa ..... 62/412
2008/0148745 A1* 6/2008 Zhang et al. ..... 62/113
2012/0024002 A1* 2/2012 Oh et al. ..... 62/344
2012/0304667 A1* 12/2012 Shin et al. ..... 62/3.6
2013/0139540 A1* 6/2013 Eckartsberg et al. ..... 62/440
2013/0167582 A1* 7/2013 Jones ..... 62/515

FOREIGN PATENT DOCUMENTS

CN 101065626 A 10/2007
CN 101080602 A 11/2007
GB 646083 A * 2/1947 ..... F25D 11/02

* cited by examiner

*Primary Examiner* — Frantz Jules
*Assistant Examiner* — Nelson Nieves
(74) *Attorney, Agent, or Firm* — Dentons US LLP

(57) ABSTRACT

A refrigerator includes a main body with a first storage compartment; a first evaporation compartment provided within the main body in order to cool the first storage compartment; and a first evaporator provided in the first evaporation compartment. The refrigerator further includes a second storage compartment independently provided in the first storage compartment including a case forming an insulation space so as to maintain a temperature lower than the first storage compartment and a drawer to insert into and remove from the case; a second evaporation compartment, independent from the first evaporation compartment, formed in the second storage compartment; and a second evaporator provided in the second evaporation compartment.

11 Claims, 5 Drawing Sheets

REFRIGERATOR

CROSS REFERENCE TO RELATED APPLICATIONS

The present application claims the priority benefit of Korean Patent Application No. 10-2013-0035088 filed on Apr. 1, 2013, which is herein incorporated by reference in its entirety.

BACKGROUND

1. Field

The present disclosure relates to a refrigerator.

2. Description of the Related Art

Generally, a refrigerator is an electronic appliance that can store foods at a low temperature within an internal storage space which is shielded by a door from an external environment. To this end, the refrigerator is configured to cool the internal storage space to keep the stored foods in an optimal state by using cool air generated by a heat exchange with a coolant that is circulated in a cooling cycle.

Recently, with increases in food shelf life and a tendency to purchase higher-grade products, the average refrigerator size has gradually enlarged and has become multifunctional. Refrigerators having various structures and convenient user equipment have been introduced.

Particularly, consumer requirements for additional storage space capable of cooling foods at a temperature significantly lower than the temperature of a freezing compartment has increased. When food is cooled to a very low temperature within a short time period, a freshness state of the food can be achieved even after thawing. Therefore, the desire for additional storage compartments capable of freezing food in a cryogenic state in a short time period increases.

SUMMARY

The present disclosure has been made in an effort to provide a refrigerator with a space, separate from a refrigerating compartment or a freezing compartment, which may deep-cool food at a temperature lower than a temperature in a freezing compartment within a short time period.

In order to achieve the object, a refrigerator according to an embodiment of the present invention includes: a first evaporation compartment provided within the main body in order to cool the first storage compartment; a first evaporator provided in the first evaporation compartment; a second storage compartment independently provided in the first storage compartment including a case forming an insulation space so as to maintain a temperature lower than the first storage compartment and a drawer to insert into and to remove from the case; a second evaporation compartment independent from the first evaporation compartment formed in the second storage compartment; and a second evaporator provided in the second evaporation compartment.

According to the refrigerator of one embodiment of the present invention, the following effects are provided.

First, by providing a drawer assembly which may be provided inside a freezing compartment and cooled at a temperature lower than a temperature in the freezing compartment, food requiring storage at various temperatures can be effectively stored.

Second, since a separate evaporation means for rapid cooling is provided, a state of a deep freezing compartment may be uniformly maintained regardless of a load state of a refrigerating compartment or a freezing compartment.

DETAILED DESCRIPTION

Figure 1:
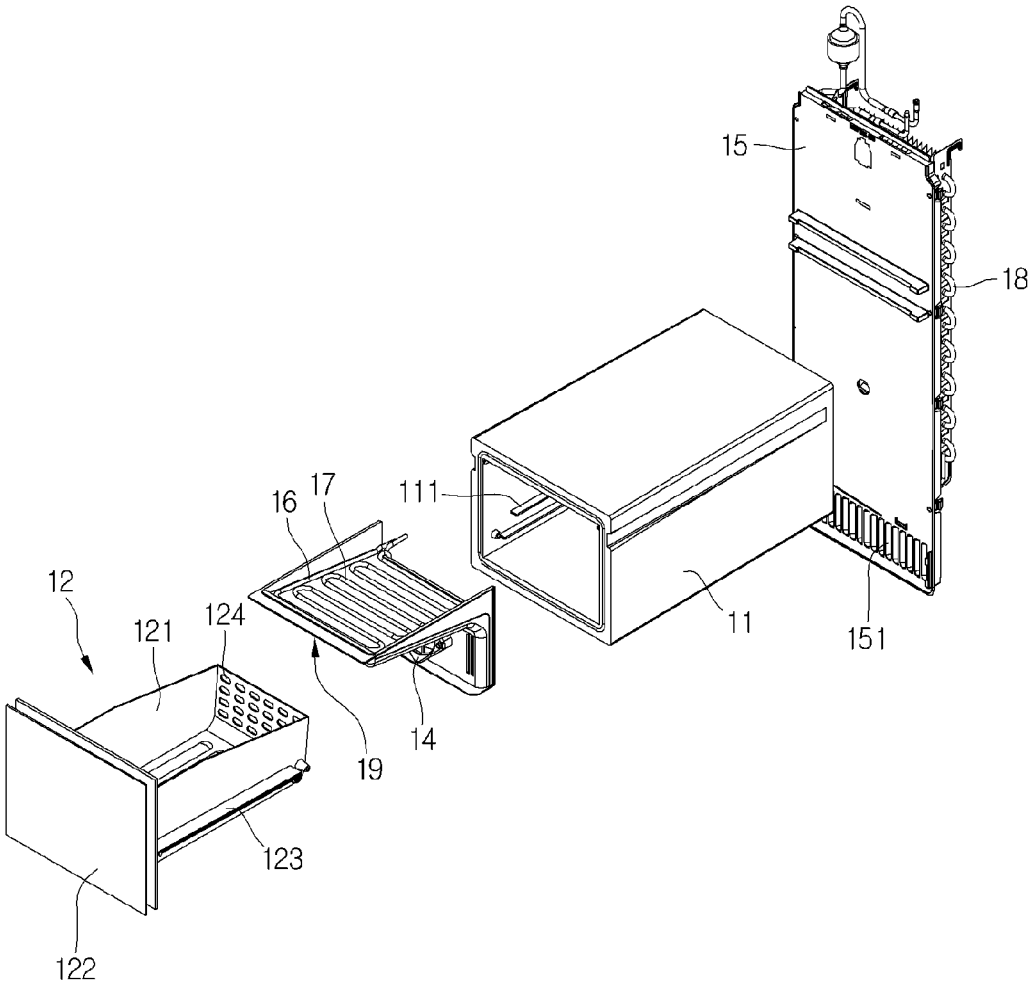
FIG. 1 is an exploded perspective view illustrating a structure of a deep freezing compartment according to one embodiment of the present invention.

In the following detailed description of the preferred embodiments, reference is made to the accompanying drawings, and in which is shown by way of illustration specific preferred embodiments in which the invention may be practiced. The embodiments are described in sufficient detail to enable those skilled in the art to practice the invention, and it is understood that other embodiments may be utilized. Logical, structural, mechanical, electrical, and chemical changes may be made without departing from the spirit or scope of the invention. To avoid details not necessary to enable those skilled in the art to practice the invention, the description may omit certain information known to those skilled in the art. The following detailed description is, therefore, not to be taken in a limiting sense, and the scope of the present disclosure is defined only by the appended claims.

A deep freezing compartment according to the embodiments of the present invention can be applied to all types of refrigerators. For example, the deep freezing compartment according to one embodiment of the present invention can be applied to all of a top mount type refrigerator in which the freezing compartment is provided on the top of a cooling compartment, a bottom freezer type refrigerator in which the freezing compartment is provided on the bottom of the cooling compartment, and a side-by-side type refrigerator in which the freezing compartment and the cooling compartment are provided at left and right sides.

A refrigerator according to an embodiment of the present invention comprises: a main body with a first storage compartment; a first evaporation compartment provided within the main body in order to cool the first storage compartment; a first evaporator provided in the first evaporation compartment; a second storage compartment, independently provided in the first storage compartment, including a case forming an insulation space so as to maintain a temperature lower than the first storage compartment and a drawer to insert into and to remove from the case; a second evaporation compartment, independent from the first evaporation compartment, formed in the second storage compartment; and a second evaporator provided in the second evaporation compartment.

Further, the refrigerator according to one embodiment of the present invention further comprises: a cool air guide partitioning the case into the second evaporation compartment and a storage space to receive the drawer, the cool air guide having a cool air outlet and a cool air inlet; a cooling fan installed in the cool air inlet to take the cool air of the storage space into the second evaporation compartment; and a heat exchange plate provided in the second evaporation compartment, wherein the second evaporator is a meandering coolant pipe bent several times and is disposed on a rear surface of the heat exchange plate.

In addition, the heat exchange plate is bent in a shape similar to the cool air guide and spaced a predetermined distance from the cool air guide, and when a cool air passage is formed between the cool air guide and the heat exchange plate.

The cool air which is taken into the second evaporation compartment from the storage space by the cooling fan flows along the cool air passage to be discharged back into the storage space.

Furthermore, the refrigerator according to one embodiment of the present invention further comprises: a cool air inflow hole formed at one side of the heat exchange plate; and one or more cool air outflow holes formed at the other side of the heat exchange plate.

The refrigerator according to one embodiment of the present invention further comprises a drain hose disposed on the bottom of the case, wherein one end of the drain hose is in communication with the second evaporation compartment and the other end is in communication with the first evaporation compartment.

Additionally, the refrigerator according to one embodiment of the present invention further comprises a damper provided in the drain hose and selectively opening and closing the drain hose.

The first evaporation compartment may include a freezing compartment.

The first evaporation compartment may include a refrigerating compartment.

FIG. 1 is an exploded perspective view illustrating a deep freezing compartment structure according to one embodiment of the present invention.

Referring to FIG. 1, the deep freezing compartment structure according to one embodiment of the present invention includes a deep freezing compartment which is maintained at a temperature lower than a freezing compartment and a cooling module for cooling an inner part of the deep freezing compartment.

The deep freezing compartment may be installed at one inner side of a freezing compartment 20 (see FIG. 3), but is not limited thereto and may be installed in a refrigerating compartment. The deep freezing compartment includes a case 11 formed in an insulation box form and a drawer 12 to insert in and to remove from the case 11. A front surface of case 11 is opened, and as a result, drawer 12 is insertable/removable. A rear surface of case 11 is shielded to prevent ambient air of a space receiving case 11 from flowing into case 11.

Drawer 12 includes a storage box 121 to hold food, and a door 122 formed on a front surface of storage box 121. A plurality of cool air holes 124 are formed on a rear surface of storage box 121, and some of cool air holes 124 serve as discharge holes to discharge the cool air supplied from the cooling module into storage box 121. Other cool air holes 124 serve as inflow holes or recovery holes through which the cool air in storage box 121 returns to the cooling module. Slide rails 123 may be formed on both outer sides of storage box 121. Additionally, guide rails 111 which are configured to receive slide rails 123 may be formed on both inner sides of case 11. Therefore, as slide rails 123 move forward and backward on guide rails 111, drawer 12 is inserted into case 11 or removed from case 11. A rolling member such as a roller may be adopted instead of the slider rails 123, or the slide rail and the roller member may be both used.

Meanwhile, the cooling module includes a cool air guide 19 that is bent and extended on a rear wall and an upper wall of the case 11, a heat exchange plate 17 that is bent and extended on the top of cool air guide 19, a deep evaporator 16 is disposed on the top of heat exchange plate 17 in a meandering path, and a deep fan 14 mounted on a front surface of cool air guide 19.

The deep freezing compartment is fixed on a front surface of a main grille 15 constituting a rear wall of the freezing compartment. A main evaporation compartment where a main evaporator 18 is placed is formed in the rear of the main grille 15. Additionally, a cool air hole 151 that allows cool air of the freezing compartment to return to the main evaporator 18 may be formed on the bottom of the main grille 15.

Figure 2:
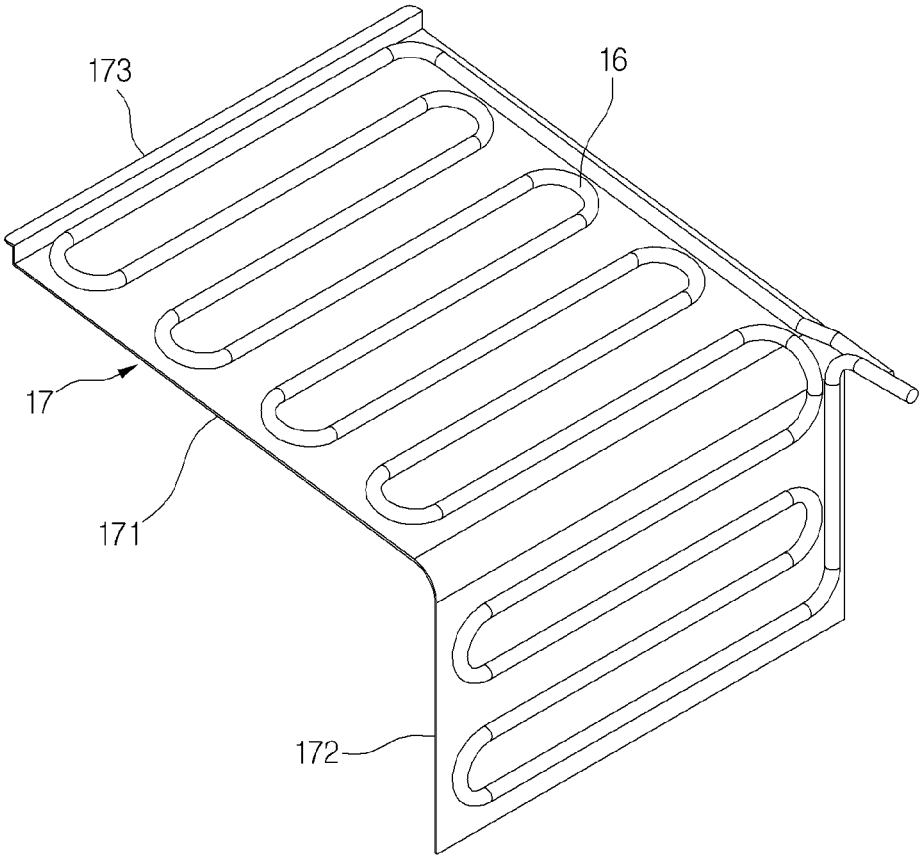
FIG. 2 is a perspective view illustrating structures of a heat exchange plate and a deep evaporator constituting a cooling module according to one embodiment of the present invention.

FIG. 2 is a perspective view illustrating structures of a heat exchange plate and a deep evaporator constituting a cooling module according to one embodiment of the present invention.

Referring to FIG. 2, according to one embodiment of the present invention, cool air for cooling the deep freezing compartment is generated by a heat exchange plate 17 bent substantially in a 'D' shape and a deep evaporator 16 attached on a bottom surface of heat exchange plate 17.

Heat exchange plate 17 includes a vertical part 172 that is extended vertically upward, and an inclination part 171 that is curved or bent from the top of vertical part 172 and is extended obliquely with a predetermined length and a suspension part 173 that is bent on the end of inclination part 171. Suspension part 173 is a part that is suspended and seated on a front end of cool air guide 19.

Heat exchange plate 17 may be formed by a metal plate such as aluminum having a high thermal transmission coefficient and deep evaporator 16 may be a coolant pipe branched from a cooling cycle. That is, main evaporator 18 and deep evaporator 16 are connected in parallel to switch the flow of the coolant depending on an operating mode. In other words, in order to cool the refrigerating compartment and/or the freezing compartment of the refrigerator with the deep freezing compartment, the coolant flows toward main evaporator 18 to operate the cooling cycle and when a deep cooling mode is set, the flow of the coolant toward main evaporator 18 is cut off and the coolant flows toward deep evaporator 16 to operate the cooling cycle. Alternatively, some of the coolant flows toward main evaporator 18 to continuously cool the refrigerating compartment or the freezing compartment and only the remaining amount of the coolant flows toward deep evaporator 16 to achieve deep cooling and cool the refrigerating compartment/freezing compartment.

Meanwhile, when a deep cooling function is performed, deep fan 14 operates, and as a result, the cool air is circulated in the deep freezing compartment. In this case, the circulated cool air exchanges heat with heat exchange plate 17 while flowing on a front surface of heat exchange plate 17. More specifically, coolant that flows through a pipe of deep evaporator 16 exchanges heat with heat exchange plate 17 by heat conduction and coolant that is circulated in the deep freezing compartment exchanges heat with heat exchange plate 17 by heat conduction. That is, the coolant that flows on deep evaporator 16 exchanges heat with the coolant in the deep freezing compartment through heat exchange plate 17.

Figure 3:
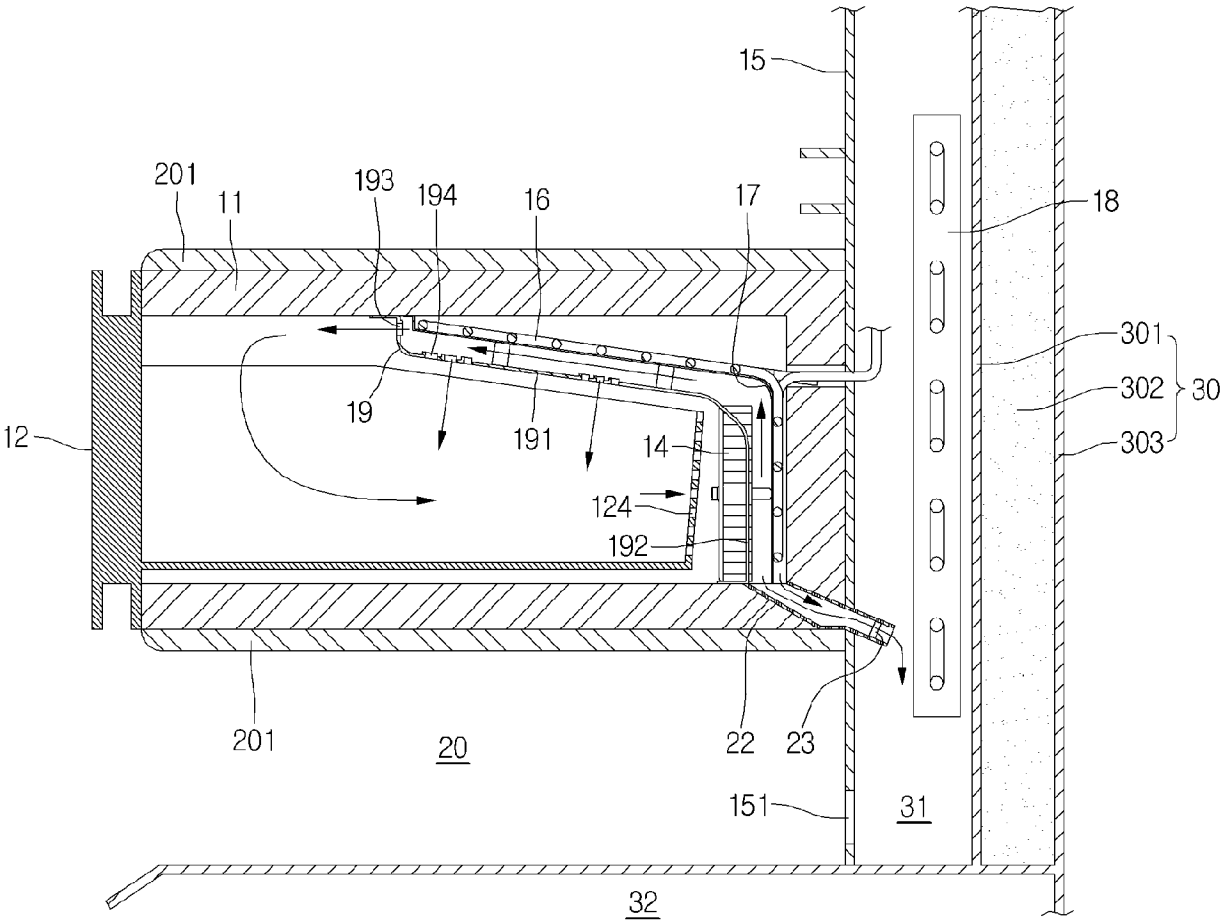
FIG. 3 is a longitudinal cross-sectional view illustrating an internal structure of a refrigerator with the deep freezing compartment according to one embodiment of the present invention.

FIG. 3 is a longitudinal cross-sectional view illustrating an internal structure of a refrigerator with the deep freezing compartment according to one embodiment of the present invention.

Referring to FIG. 3, the deep freezing compartment according to one embodiment of the present invention is installed at one inner side of the refrigerating compartment or the freezing compartment 20 provided in a refrigerator body 30.

Refrigerator body 30 comprises an outer case 303 and an inner case 301, and an insulation layer 302 interposed therebetween. A refrigerating compartment (not illustrated) and the freezing compartment 20 are provided in body 30. Additionally, main grille 15 is mounted at a point spaced forward from inner case 301 and a main evaporation compartment 31 is formed between main grille 15 and inner case 301. Further, main evaporator 18 is installed in main evaporation compartment 31. Main grille 15 defines a rear wall of freezing compartment 20 or the refrigerating compartment. Moreover, a rear surface of case 11 constituting the deep freezing compartment may be fixed to the inside of freezing compartment 20 while being closely attached to the front surface of main grille 15. A plurality of shelves 201 may be installed vertically at a predetermined interval in the storage compartment including freezing compartment 20, and the deep freezing compartment may also be disposed in a space among the plurality of shelves 201. Additionally, the width of case 11 may be smaller than that of freezing compartment 20 and may have a length corresponding to a forward/downward length of freezing compartment 20.

Low-temperature cool air generated in main evaporation compartment 31 is ejected to freezing compartment 20 and the refrigerating compartment along a cool air passage. An evaporation compartment for the refrigerating compartment and an evaporation compartment for the freezing compartment may be provided, respectively, depending on a product design.

Meanwhile, the cool air guide 19 is extended along a rear surface and a top surface of case 11 as illustrated in FIG. 3. Cool air guide 19 includes a vertical part 192 that is extended from the bottom to the top of case 11 with a predetermined length and an inclination part 191 that is bent forward of case 11 and extended obliquely on the top surface of case 11. Additionally, cool air guide 19 is bent and extended to an upper side from a front end of inclination part 191 to be fixed to the top surface of case 11. A front surface of cool air guide 19, that is, a surface that is bent and extended to the upper side from the front end of inclination part 191 may be positioned substantially at the center or forward of the center of case 11. Moreover, a front discharge hole 193 may be formed on the front surface of cool air guide 19 and a top discharge hole 194 may be formed at a plurality of points along the inclination part 191. Deep fan 14 is mounted on vertical part 192, and as a result, the cool air in case 11 is taken in and circulated.

Suspension part 173 formed on the front end of heat exchange plate 17 is extended over the front end of cool air guide 19 to allow the cool air passage to be formed between heat exchange plate 17 and cool air guide 19. Therefore, when the cool air in case 11 is taken in by deep fan 14, the cool air is circulated on the cool air passage formed between cool air guide 19 and heat exchange plate 17. More specifically, the cool air that is introduced through the cool air passage is cooled by contact with heat exchange plate 17 and is discharged to the inside of case 11 through front discharge hole 193 and top discharge hole 194 while moving along inclination part 191 of cool air guide 19.

Further, since the rear surface of case 11 is shielded and a front opening of case 11 is shielded by door 122 of drawer 12, the cool air in the deep freezing compartment is circulated only in the deep freezing compartment.

Meanwhile, a drain pipe 22 is mounted on a rear bottom of case 11. In detail, one end of drain pipe 22 is in communication with the cool air passage between cool air guide 19 and heat exchange plate 17 and the other end is in communication with the main evaporation compartment 31. Therefore, condensed water generated in deep evaporator 17 and the cool air passage flows along drain pipe 22 to be guided to the main evaporation compartment 31. In addition, condensed water collected in the main evaporation compartment 31 flows to a machine compartment 32 provided on the bottom of refrigerator body 30 through another drain pipe (not illustrated). In order to prevent the cool air that flows on the cool air passage from being mixed with hot air in machine room 32 through the drain pipe 22, a damper 23 may be mounted in drain pipe 22. That is, a member may be installed, in such a manner that damper 23 is opened by a weight of the condensed water and when the condensed water is discharged a member is configured to be closed again.

Figure 4:
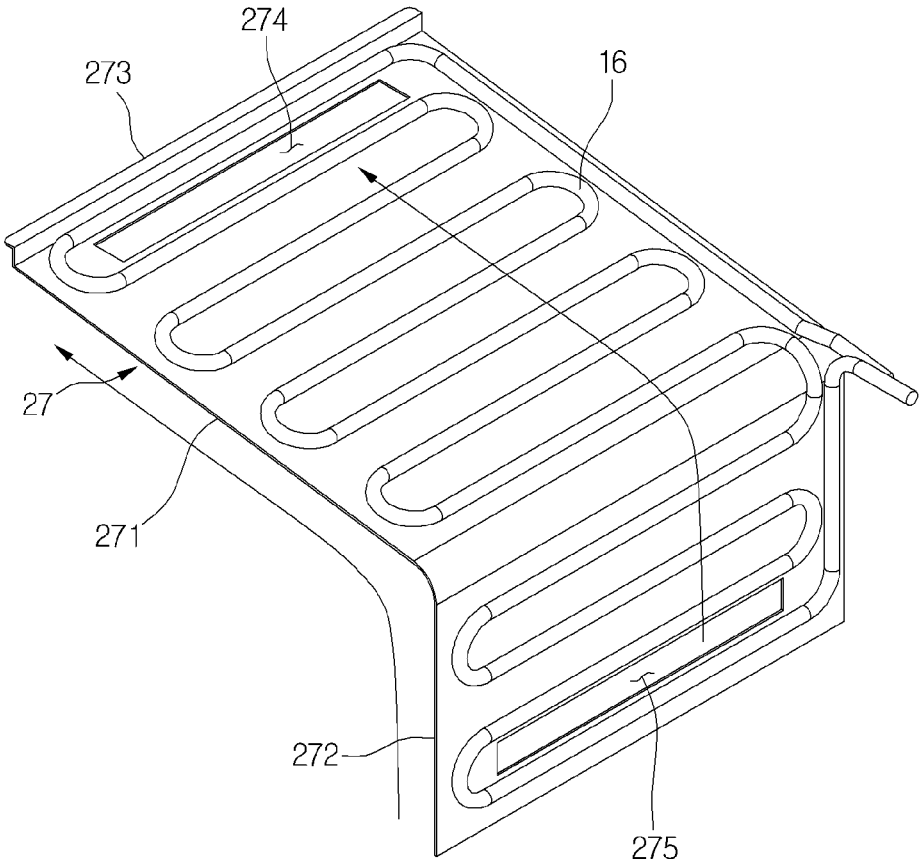
FIG. 4 is a perspective view illustrating a cooling module according to another embodiment of the present invention.
Figure 5:
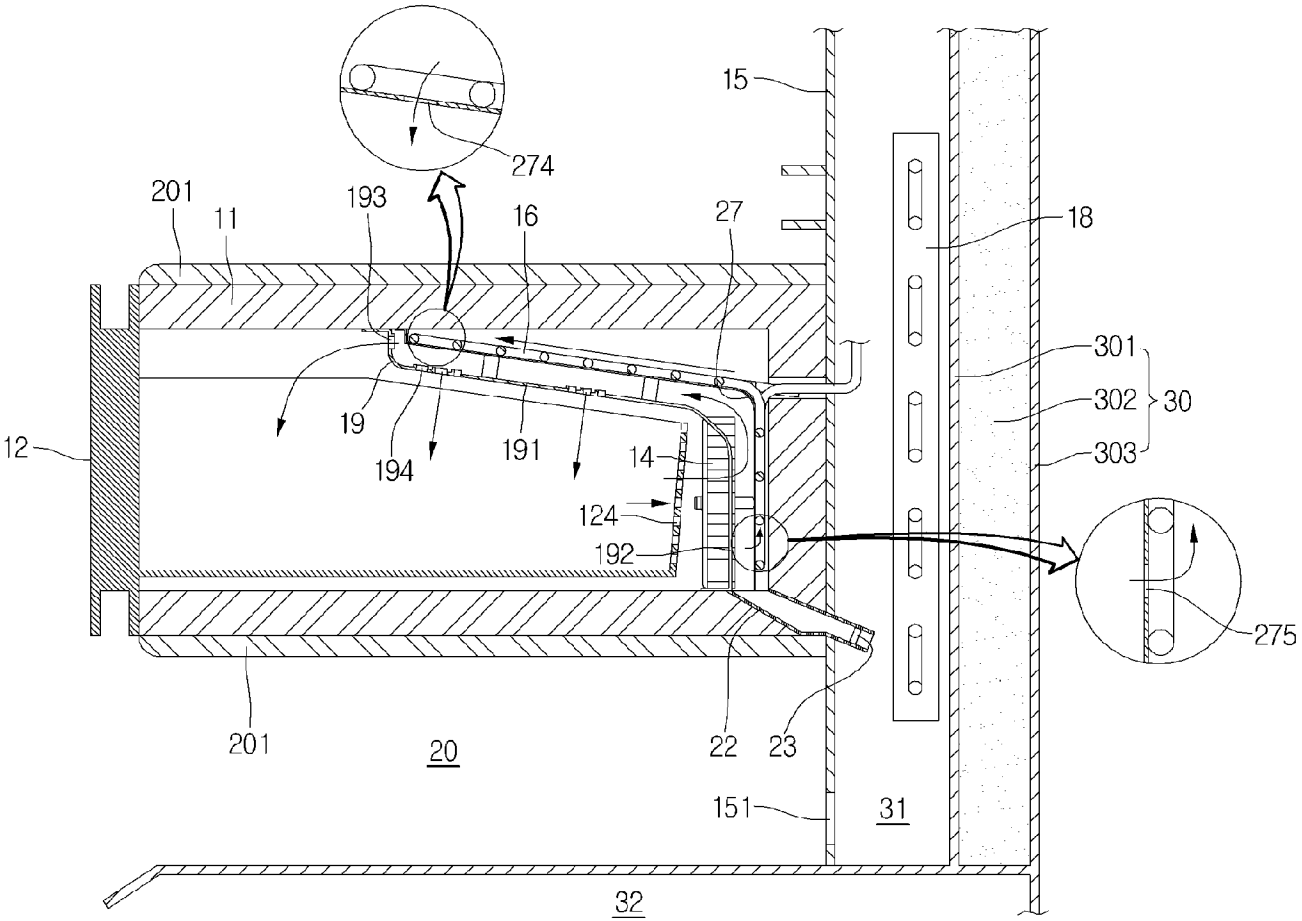
FIG. 5 is a cross-sectional view illustrating a structure of the refrigerator mounted with the cooling module of FIG. 4.

FIG. 4 is a perspective view illustrating a cooling module according to another embodiment of the present invention and FIG. 5 is a cross-sectional view illustrating a structure of a refrigerator mounted with the cooling module of FIG. 4.

Referring to FIG. 4, in that a heat exchange plate 27 constituting the cooling module according to one embodiment is constituted by a vertical part 272, an inclination part 271, and a suspension part 273, the embodiment is the same as the previous embodiment. Additionally, even in that the deep evaporator 16 is disposed in a meandering path on the rear surface of heat exchange plate 27, the embodiment is the same as the previous embodiment. Further, in that damper 23 is mounted in drain pipe 22, the embodiment is the same as the previous embodiment. However, in that a cool air inlet 275 and a cool air discharge hole 274 are formed in bottom and front end regions of heat exchange plate 27, respectively, the embodiment is different from the previous embodiment.

More specifically, in the case of the previous embodiment, the cool air that is taken in by deep fan 14 is circulated on the cool air passage formed between cool air guide 19 and heat exchange plate 17, but in the case of the present embodiment, some of the cool air that is taken in by deep fan 14 is guided along the rear surface of heat exchange plate 27 through cool air inlet 275, as illustrated in FIG. 5. That is, when the cool air in the deep freezing compartment is taken in to the cooling module by deep fan 14, some of the cool air is cooled through heat exchange with the heat exchange plate and some reaming cool air is cooled by direct heat exchange with deep evaporator 16. Therefore, a cooling time is shortened and cooling efficiency is further increased.

Meanwhile, a first evaporator may comprise, among other things, main evaporator 18 as described in the embodiments above, and a second evaporator may comprise, among other things, deep evaporator 16. In addition, a first storage compartment may comprise, among other things, freezing compartment 20, and a second storage compartment may comprise, among other things, deep freezing compartment 10 provided in freezing compartment 20.

What is claimed is:

1. A refrigerator, comprising:

a main body having a first storage compartment;

a first evaporation compartment provided within the main body in order to cool the first storage compartment;

a first evaporator provided in the first evaporation compartment;

a second storage compartment independently provided in the first storage compartment and the second storage compartment including:

a case forming an insulation space so as to maintain a temperature lower than the first storage compartment; and a drawer to be received in or withdrawn from the insulation space and including a storage box and a door formed on a front surface of the storage box;

a second evaporation compartment, independent from the first evaporation compartment, formed in the second storage compartment;

a second evaporator provided in the second evaporation compartment;

a cool air guide partitioning the case into the second evaporation compartment and a storage space to receive the drawer, the cool air guide having a cool air outlet and a cool air inlet;

a cooling fan installed in the cool air inlet to take cool air of the storage space into the second evaporation compartment; and a heat exchange plate provided in the second evaporation compartment, the heat exchange plate configured to partition the second evaporation compartment into a first cool air passage and a second cool air passage, the first cool air passage being defined at a front of the heat exchange plate and the second cool air passage being defined at a rear portion of the heat exchange plate, wherein the heat exchange plate includes:

a cool air inflow hole formed at one side thereof; and a cool air outflow hole formed at an other side thereof, wherein the second evaporator is a meandering coolant pipe and is disposed on a rear surface of the heat exchange plate to be exposed in the second cool air passage, wherein the cool air in the storage space is configured to be discharged by the cooling fan, wherein a portion of the cool air discharged by the cooling fan is introduced in the first cool air passage through the cool air inlet of the cool air guide to indirectly heat exchange with the second evaporator through a front surface of the heat exchange plate, and flows into the storage space through the cool air outlet of the cool air guide, and wherein an other portion of the cool air is introduced through the cool air inflow hole of the heat exchange plate to directly heat exchange with the second evaporator, and flows into the first cool air passage through the cool air outflow hole of the heat exchange plate.

2. The refrigerator of claim 1, further comprising:

a drain hose disposed on a bottom of the case, wherein one end of the drain hose is in communication with the second evaporation compartment and an other end is in communication with the first evaporation compartment.

3. The refrigerator of claim 2, further comprising:

a damper provided in the drain hose and selectively opening and closing the drain hose.

4. The refrigerator of claim 1, wherein the first evaporation compartment is defined behind a freezing compartment.

5. The refrigerator of claim 1, wherein the first evaporation compartment is defined behind a refrigerating compartment.

6. The refrigerator of claim 1, wherein the first evaporation compartment is provided at one side of the main body.

7. The refrigerator of claim 1, wherein a front open surface of the case is shielded by the door of the drawer.

8. The refrigerator of claim 1, wherein the first evaporator comprises a main evaporator.

9. The refrigerator of claim 1, wherein the second evaporator comprises a deep freezing evaporator.

10. The refrigerator of claim 1, wherein the first storage compartment includes a freezing compartment.

11. The refrigerator of claim 1, wherein the second storage compartment includes a deep freezing compartment.

* * * * *